US007867307B2

(12) United States Patent
Bates et al.

(10) Patent No.: US 7,867,307 B2
(45) Date of Patent: Jan. 11, 2011

(54) CYCLONIC SEPARATING APPARATUS FOR A CLEANING APPLIANCE

(75) Inventors: Adam James Bates, Malmesbury (GB); Timothy Nicholas Stickney, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 261 days.

(21) Appl. No.: 12/243,484

(22) Filed: Oct. 1, 2008

(65) Prior Publication Data

US 2009/0100633 A1 Apr. 23, 2009

(30) Foreign Application Priority Data

Oct. 18, 2007 (GB) ..... 0720341.7

(51) Int. Cl.
*B01D 45/12* (2006.01)

(52) U.S. Cl. ..... 55/343; 55/349; 55/429; 55/433; 55/DIG. 3

(58) Field of Classification Search ..... 55/343, 55/346, 349, 429, 432, 433, 459.1, DIG. 3
See application file for complete search history.

(56) References Cited

U.S. PATENT DOCUMENTS

| | | | | |
|---|---|---|---|---|
| 3,486,618 | A | 12/1969 | Wikdahl | |
| 4,687,497 | A | 8/1987 | Owen et al. | |
| 5,000,767 | A * | 3/1991 | Sanders et al. | 55/302 |
| 6,607,572 | B2 * | 8/2003 | Gammack et al. | 55/343 |
| 6,835,222 | B2 | 12/2004 | Gammack | |

FOREIGN PATENT DOCUMENTS

| | | | |
|---|---|---|---|
| GB | 2 386 827 | A | 10/2003 |
| GB | 2 441 300 | A | 3/2008 |
| JP | 2002-326041 | | 11/2002 |
| JP | 2003-156002 | | 5/2003 |
| JP | 2003-528704 | | 9/2003 |
| JP | 2004-229827 | | 8/2004 |
| KR | 10-2007-0012988 | | 1/2007 |
| WO | WO-02/067742 | A2 | 9/2002 |

OTHER PUBLICATIONS

GB Search Report, dated Feb. 12, 2008, directed to corresponding GB Patent Application No. GB0720341.7; 1 page.
International Search Report and Written Opinion mailed on Jan. 5, 2009, directed to counterpart International Patent Application No. PCT/GB2008/003376; 14 pages.

* cited by examiner

*Primary Examiner*—Robert A Hopkins
(74) *Attorney, Agent, or Firm*—Morrison & Foerster LLP

(57) ABSTRACT

A cyclonic separating apparatus for a cleaning appliance includes a plurality of cyclonic separators arranged in series for separating particles from a dirt- and dust-laden airflow, at least two or three collectors for collecting separated dirt and dust, and a closure member movable between a closed position in which the closure member closes an end of each collector and an open position in which separated dirt and dust can be emptied from the collectors. The ends of the collectors are separated by dividing walls. A expandable seal is provided between the closure member and the dividing walls to seal when the closure member is in the closed position. The expandable seal is able to seal effectively even if the closure member is misaligned, incorrectly fitted or if dirt and dust is present between the surfaces to be sealed.

15 Claims, 6 Drawing Sheets

CYCLONIC SEPARATING APPARATUS FOR A CLEANING APPLIANCE

REFERENCE TO RELATED APPLICATIONS

This application claims the priority of United Kingdom Application No. 0720341.7, filed Oct. 18, 2007, the contents of which are incorporated herein by reference.

FIELD OF THE INVENTION

The present invention relates to cyclonic separating apparatus for a cleaning appliance. Particularly, but not exclusively, the present invention relates to cyclonic separating apparatus for a vacuum cleaner.

BACKGROUND OF THE INVENTION

Vacuum cleaners which utilise cyclonic separating apparatus are well known. Examples of such vacuum cleaners are shown in EP 0 042 723, EP 1 370 173 and EP 1 268 076. In general, an airflow in which dirt and dust is entrained enters a first cyclonic separator via a tangential inlet which causes the airflow to follow a spiral or helical path within the first cyclonic separator so that the dirt and dust is separated from the airflow. Relatively clean air passes out of the chamber while the separated dirt and dust is collected in a first collector. In some applications, and as described in EP 0 042 723, the airflow is then passed to a second cyclonic separator which is capable of separating finer dirt and dust than the first cyclonic separator. The cleaned airflow then exits the cyclonic separating apparatus, and the separated fine dirt and dust is collected in a second collector.

The absence of a bag in a cyclonic vacuum cleaner can create difficulties for the disposal of the dirt and dust which is collected by the cleaner. When the collectors of a vacuum cleaner such as that described in EP 0 042 723 become full, a user typically removes the cyclonic separating apparatus from the main body of the machine and tips the collectors upside down. Often it may be necessary for the user to dislodge the dirt manually, which can be inconvenient.

An improved arrangement is disclosed in EP 1 023 864, which describes a vacuum cleaner with separating apparatus which can be removed from a main body of the cleaner for emptying. A lower closure of the separating apparatus is attached by way of a hinge to the remainder of the separating apparatus and the closure can be released by pressing a release button. Although it is desirable to provide a separating apparatus which can be emptied in this way, it can be difficult to seal the lower closure reliably against the remainder of the separating apparatus.

An improved sealing arrangement is described in EP 1 370 172. The described vacuum cleaner has a first and a second cyclonic separator, each having a separate collector. The collectors are annular and the first collector surrounds the second collector. Attached to the lower end of an annular wall separating the two collectors is a depending annular seal. A hinged closure member is connected to the base of the first collector and which can be released to empty the two collectors. When the closure member is moved to a closed position, the seal is wiped against a part of the closure member, ensuring that the sealing surface is clear of dirt and dust, and allowing the seal to be stretched slightly by engagement with the closure member when in the closed position. This helps to maintain the sealing action.

An alternative sealing arrangement is used on a range of vacuum cleaners sold by Dyson™ under the trade name DC12™. These vacuum cleaners also have two cyclonic separators, each having a separate collector. In this arrangement, a hinged closure member carries a small annular seal which seals against a wall separating the two collectors.

However, a problem associated with both of the above arrangements is that the seal may become less effective with use; for example, the seal may become worn or brittle and may not seal correctly. Also, with an arrangement using a movable closure member, there is a risk that the user may not return the closure member to the correct closed position after emptying the collectors. The above situations may lead to ineffective sealing between the collectors and leaks occurring therebetween. This is undesirable because separated dirt and dust can move between the collectors and may become re-entrained in the airflow, reducing the efficiency at which the cyclonic separating apparatus operates. Leaks between collectors may also lead to unwanted pressure drops, again reducing the efficiency at which the cyclonic separating apparatus operates.

SUMMARY OF THE INVENTION

It is an object of the present invention to improve the sealing of a closure member to the remainder of the cyclonic separating apparatus. It is a further object of the invention to provide a seal which is able to seal efficiently at least two collectors.

According to the invention, there is provided cyclonic separating apparatus for a cleaning appliance, the cyclonic separating apparatus comprising a plurality of cyclonic separators arranged in series for separating particles from a dirt- and dust-laden airflow, a plurality of collectors for collecting the separated dirt and dust, and a closure member movable between a closed position in which the closure member closes an end of each collector and an open position in which separated dirt and dust can be emptied from the collectors, the ends of the collectors being separated by at least one dividing wall, wherein an expandable seal is provided to seal between the closure member and the at least one dividing wall when the closure member is in the closed position.

By providing an expandable seal which seals between the at least one dividing wall and the closure member, the seal is able to seal effectively even if the closure member is misaligned, incorrectly fitted or if dirt and dust is present between the surfaces to be sealed. This is because the seal is able to expand in order to seal tightly between the surfaces to be sealed.

Preferably, the seal is expandable in response to a pressure difference across a surface of the seal. By providing a seal which is able to expand or contract depending upon the pressure differential applied across a surface thereof, reliable and effective sealing between collectors can be achieved when the cyclonic separating apparatus is in use. Further, when the apparatus is switched off, the parts being sealed can be separated easily.

Preferably, the seal is located over a channel formed on the closure member. More preferably, the channel and seal form a cavity which is open to the atmosphere. By providing a channel in this manner, the seal can be conveniently located on the closure member, and a cavity can be formed by the seal and the channel. The cavity is adapted to be open to the atmosphere which allows a pressure differential to be created across the surface of the seal when the cyclonic separating apparatus is in use.

BRIEF DESCRIPTION OF THE DRAWINGS

Embodiments of the invention will now be described with reference to the accompanying drawings, in which.

DETAILED DESCRIPTION OF THE INVENTION

Figure 1:
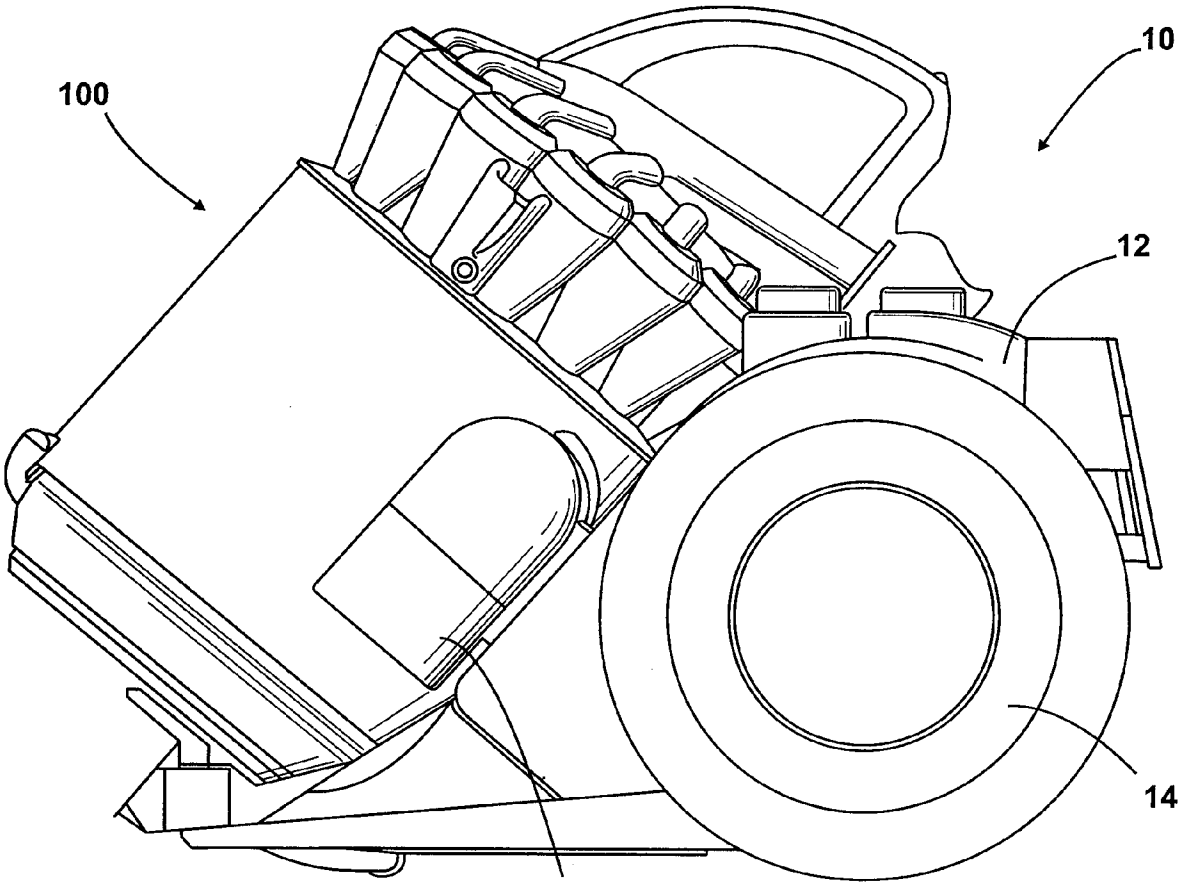
FIG. 1 is a side view of a cylinder vacuum cleaner including cyclonic separating apparatus according to a first embodiment of the invention.
Figure 2:
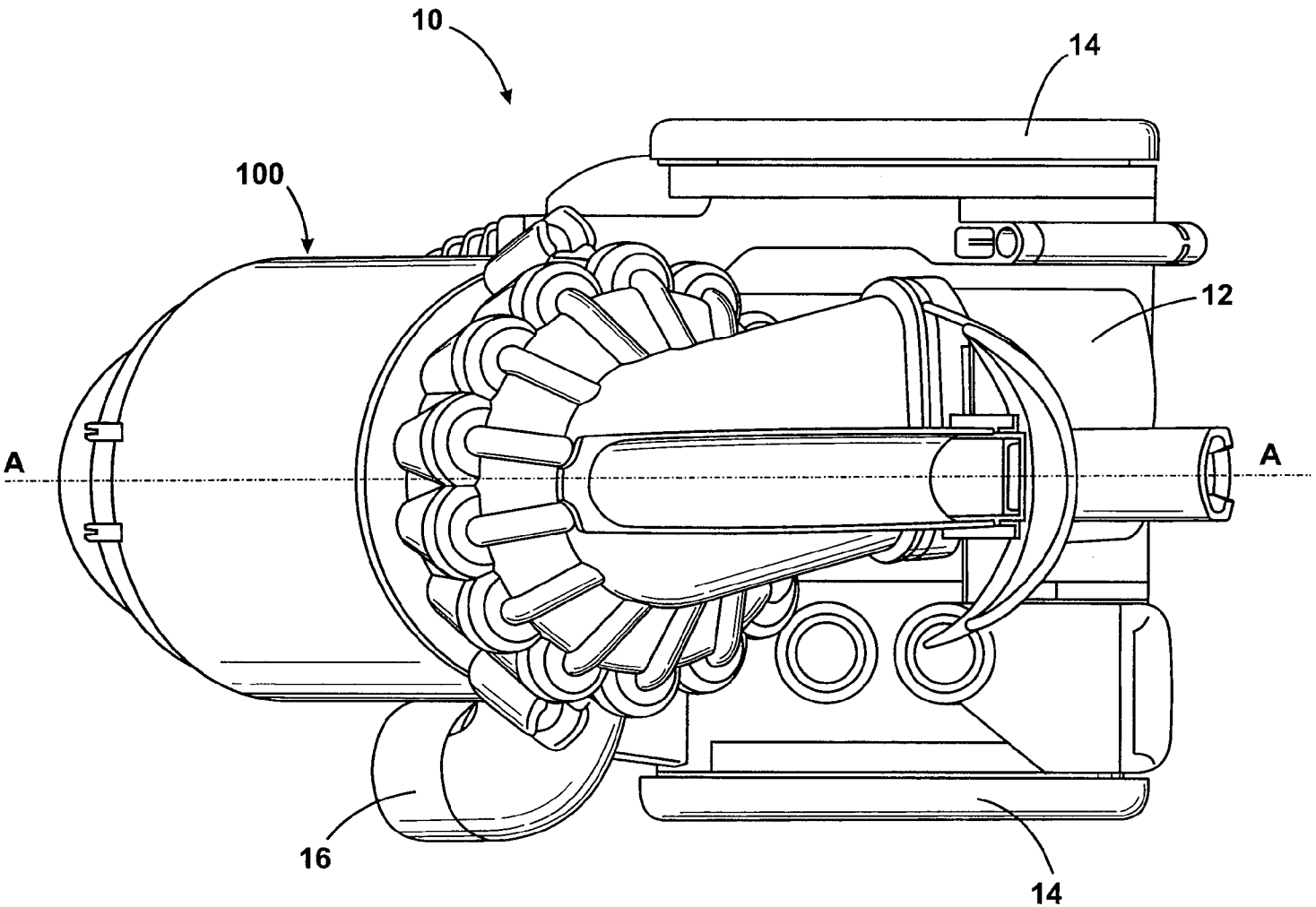
FIG. 2 is a plan view of the cylinder vacuum cleaner of FIG. 1.

A cylinder vacuum cleaner 10 incorporating cyclonic separating apparatus according to a first embodiment of the invention is shown in FIGS. 1 and 2. The vacuum cleaner 10 has a main body 12 housing a motor and fan unit (not shown) and to which a pair of wheels 14 is attached. The wheels 14 allow the main body 12 of the vacuum cleaner 10 to be manoeuvred across a floor surface. A dirty air inlet 16 is formed on the main body 12. A hose and wand assembly (not shown) can be connected to the dirty air inlet 16 in order to enable a user to clean a floor surface.

Cyclonic separating apparatus 100 according to a first embodiment of the invention is releasably attached to the main body 12. The interior of the cyclonic separating apparatus 100 is in communication with the dirty air inlet 16 through which a dirt-laden airflow enters the cyclonic separating apparatus 100. The cyclonic separating apparatus 100 can be removed from the main body 12 for emptying purposes.

Figure 3:
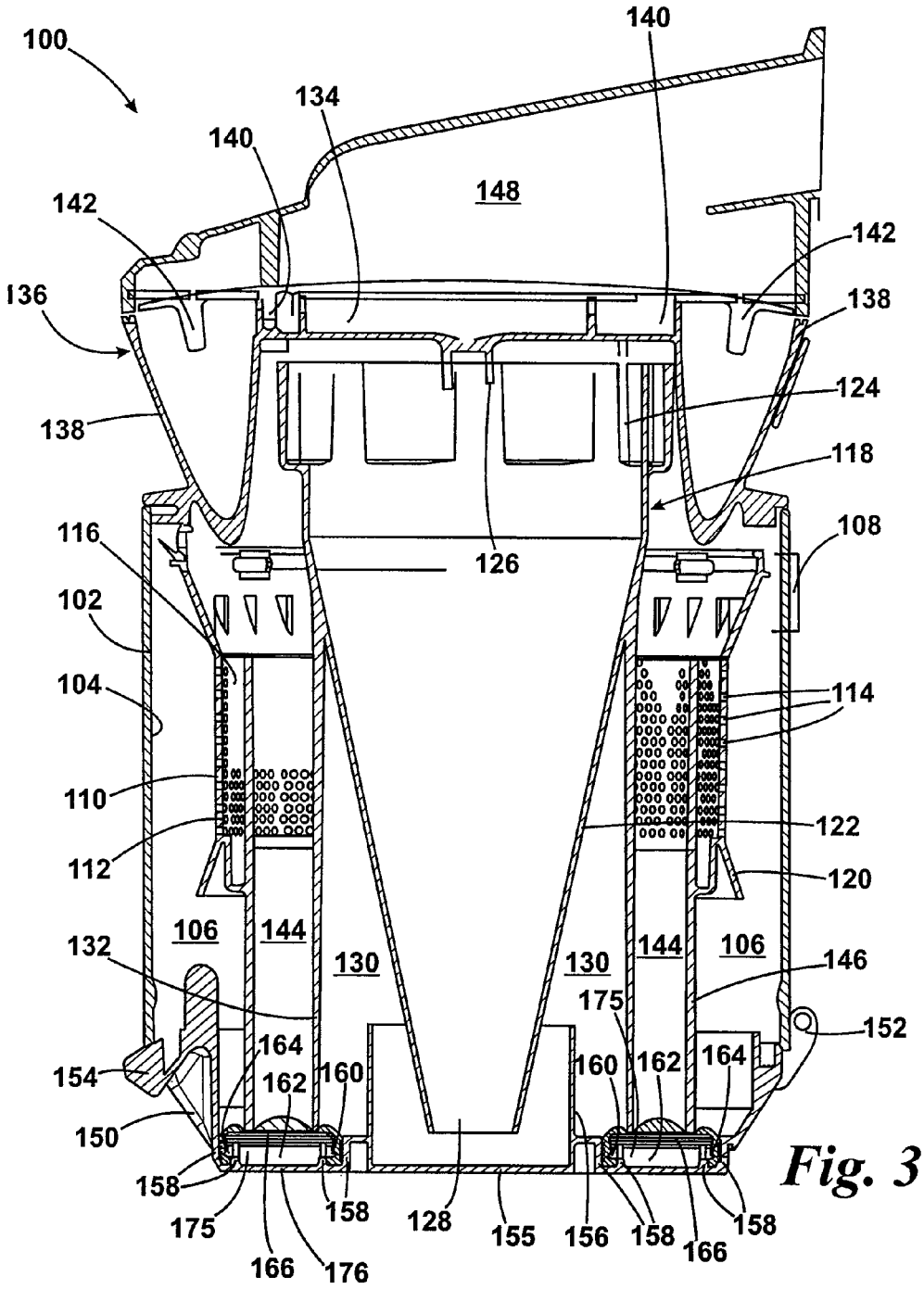
FIG. 3 is a side section taken along the line A-A of FIG. 2 showing the cyclonic separating apparatus removed from the cylinder vacuum cleaner of FIG. 1.

The cyclonic separating apparatus 100 is shown in more detail in FIG. 3, in which the cyclonic separating apparatus 100 is shown removed from the remainder of the vacuum cleaner 10 for clarity. The cyclonic separating apparatus 100 comprises a substantially cylindrical outer wall 102. The outer wall 102 defines a first cyclonic separator 104 and a first collector 106. Dirt and dust is both separated by the first cyclonic separator 104 and collected in the first collector 106 in this region. An inlet 108 is formed in the outer wall 102. The inlet 108 forms a communication path between the dirty air inlet 16 and the interior of the first cyclonic separator 104. The air inlet 108 is arranged tangentially to the first cyclonic separator 104 so that the incoming air is forced to follow a helical path around the interior of the outer wall 102.

A shroud 110 is located inwardly of the outer wall 102 of the first cyclonic separator 104. The shroud 110 comprises a cylindrical wall 112 having a plurality of through-holes 114. The shroud 110 surrounds an outlet 116 from the first cyclonic separator 104. The outlet 116 provides a communication path between the first cyclonic separator 104 and a second cyclonic separator 118. A lip 120 is provided at the base of the shroud 110. The lip 120 helps prevent separated dirt and dust from being re-entrained back into the airflow within the first cyclonic separator 104.

The second cyclonic separator 118 comprises a single cyclone 122. The single cyclone 122 has an air inlet 124 and an air outlet 126, both of which are located at a first end of the single cyclone 122. A cone opening 128 is located at a second end of the single cyclone 122. A second collector 130 is also located at the second end of the single cyclone 122 and is in communication with the cone opening 128. The second collector 130 is delimited by a cylindrical wall 132 which depends from an outer surface of the single cyclone 122 and which is located inwardly of the shroud 110. The air outlet 126 of the single cyclone 122 is in communication with a duct 134. The duct 134 provides a communication path between the second cyclonic separator 118 and a third cyclonic separator 136.

The third cyclonic separator 136 comprises a plurality of high-efficiency cyclones 138 arranged in parallel. In this embodiment, fourteen high-efficiency cyclones 138 are provided. Each high-efficiency cyclone 138 has a tangentially-arranged air inlet 140 and an air outlet 142. Each air inlet 140 and air outlet 142 is located at a first end of the respective high-efficiency cyclone 138. A cone opening (not shown) is located at a second end of each high-efficiency cyclone 138.

A third collector 144 is located at the second end of the high-efficiency cyclones 138 and is in communication with the cone openings of the high-efficiency cyclones 138. The third collector 144 is delimited by the cylindrical wall 132 and a cylindrical wall 146 which is located between the shroud 110 and the cylindrical wall 132. The cylindrical wall 146 depends from an upper part of the shroud 110 and is also connected to the shroud at a point approximately half way down the cylindrical wall 146. Therefore, the third collector 144 is an annular chamber located between the first collector 106 and the second collector 130.

The first, second and third collectors 106, 130, 144 are arranged concentrically. The second and third collectors 130, 144 are arranged inside the first collector 106. The second collector 130 is also arranged inside the third collector 144. The ends of the collectors 106, 130, 144 are separated by dividing walls 132, 146. The ends of the first and third collectors 106, 144 are divided by cylindrical wall 146, and the ends of the second and third collectors 130, 144 are divided by cylindrical wall 132.

The air outlets 142 of the high-efficiency cyclones 138 are in communication with an outlet 148. The outlet 148 provides an airflow path from the cyclonic separating apparatus 100 into other parts of the vacuum cleaner 10. Located downstream of the outlet 148 is a pre-motor filter (not shown), the motor and fan unit and a post-motor filter (not shown).

A closure member 150 closes the lower end of the cyclonic separating apparatus 100. The closure member 150 is pivotably mounted on the lower end of the outer wall 102 by means of a hinge 152. The closure member 150 is retained in a closed position (as shown in FIG. 3) by means of a catch 154. The closure member 150 comprises a base 155 and an inner annular wall 156 extending into the second collector 130. The inner annular wall 156 helps to reduce the risk of dirt and dust separated by the single cyclone 122 of the second cyclonic separator 118 being re-entrained into the airflow leaving the single cyclone 122.

The closure member 150 also includes four further annular walls 158 concentric with and arranged radially outside the inner annular wall 156. Adjacent annular walls 158 delimit three concentric, annular channels 160, 162, 164. The three annular channels 160, 162, 164 comprise a relatively wide channel 162 flanked by two relatively narrow channels 160, 164.

Figure 4:
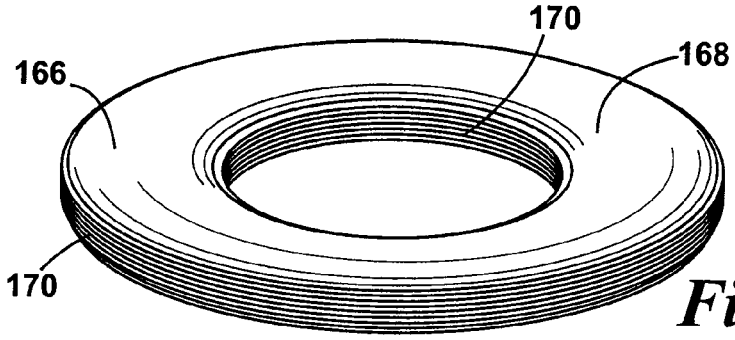
FIG. 4 is perspective view of a seal of the cyclonic separating apparatus of FIG. 3.
Figure 5:
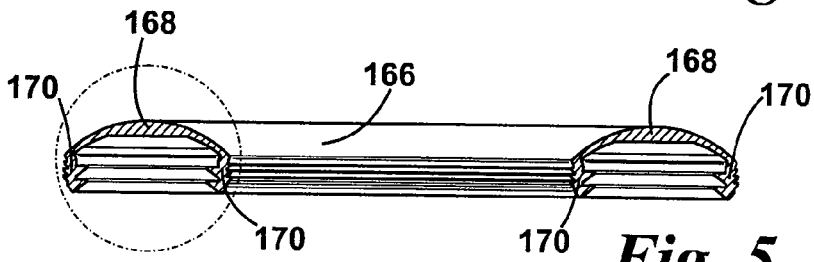
FIG. 5 is a side section of the seal of FIG. 4.
Figure 6:
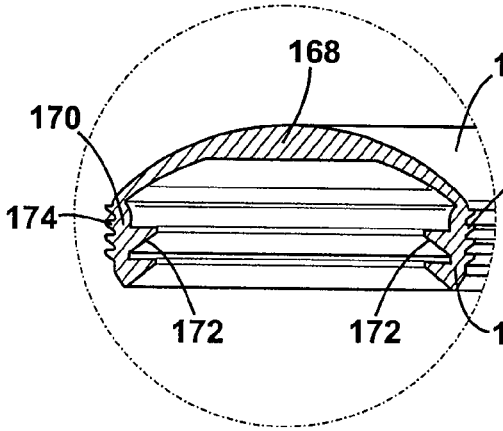
FIG. 6 is an enlarged view of a part of FIG. 5.

An annular seal 166 is attached to the closure member 150. The annular seal 166 is shown in more detail in FIGS. 4 to 6. In these figures, the annular seal 166 is shown removed from the remainder of the cyclonic separating apparatus 100. The annular seal 166 has a convex upper surface 168 and two side walls 170 which depend therefrom. The annular seal 166 is manufactured from a flexible material such as a rubber.

The convex upper surface 168 has an increased thickness towards the uppermost portion thereof. The side walls 170 have a sawtooth profile on both an internal surface 172 and an external surface 174 thereof. This is shown most clearly in FIG. 6. On the internal surfaces 172, the sawtooth profile comprises two teeth which define two circumferential grooves around the internal surfaces 172 of the side walls 170. The sawtooth profile on the external surfaces 174 comprises four smaller teeth which define four circumferential grooves around the external surfaces 174.

Figure 7:
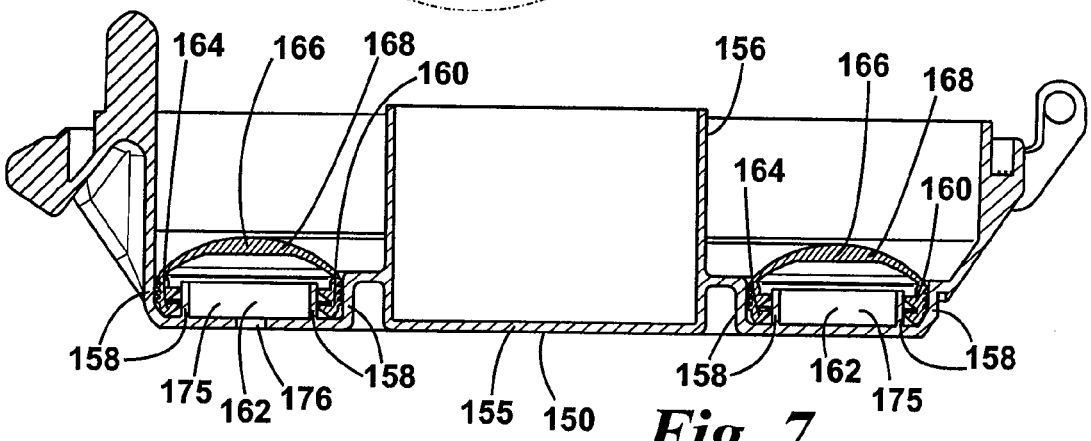
FIG. 7 is a side section of a closure member forming part of the cyclonic separating apparatus of FIG. 3.

FIG. 7 shows a cross-section of the closure member 150 with the annular seal 166 attached thereto. Each side wall 170 of the annular seal 166 is located in a respective relatively narrow annular channel 160, 164 of the closure member 150. The annular seal 166 is held in place by the engagement of the teeth located on the inner and outer surfaces 172, 174 of the side walls 170 of the annular seal 166 with the annular walls 158 of the closure member 150. As a result, the upper surface 168 of the annular seal 166 covers the relatively wide annular channel 162 of the closure member 150 to define a cavity 175.

A plurality of through-holes 176 (although only one is shown in FIG. 7) are formed in the base 155 of the closure member 150 to provide a communication path between the cavity 175 and the external atmosphere. Therefore, the cavity 175 will remain at atmospheric pressure, irrespective of the pressure inside the cyclonic separating apparatus 100. However, due to the speed of the airflow within the cyclonic separating apparatus 100, the pressure within the cyclonic separating apparatus 100 will be below atmospheric, resulting in a pressure drop across the upper surface 168 of the annular seal 166. Due to its flexible nature, the annular seal 166 will change shape depending upon the magnitude of the pressure difference established across the convex upper surface 168 thereof. In other words, the annular seal 166 is an expandable seal as it is able to expand, or inflate, when there is a positive pressure in the cavity relative to that within the cyclonic separating apparatus 100. The operation of the annular seal 166 is described in more detail below.

The annular seal 166 is shown in a "relaxed" position in FIG. 7, in which there is no pressure difference across the convex upper surface 168 of the annular seal 166. When the closure member 150 is closed (as shown in FIG. 3), the upper surface 168 of the annular seal 166 will be compressed by the ends of the cylindrical walls 132, 146 to effect a seal between closure member 150 and the three collectors 106, 130, 144 even when there is no pressure drop across the upper surface 168 of the annular seal 166.

In use, the motor and fan unit draws a flow of dirt-laden air through the hose and wand, into the dirty air inlet 16, through the inlet 108 and into the cyclonic separating apparatus 100. Due to the tangential arrangement of the inlet 108, the airflow is forced to follow a helical path around the interior of the outer wall 102. Therefore, larger dirt and dust particles are separated by cyclonic motion in the first cyclonic separator 104. These particles are collected in the first collector 106.

The partially-cleaned airflow then flows back up the interior of the first cyclonic separator 104 and exits the first cyclonic separator 104 via the through-holes 114 in the shroud 110. Once the airflow has passed through the shroud 110, it enters the outlet 116 and from there enters the inlet 124 of the single cyclone 122 of the second cyclonic separator 118. The single cyclone 122 has a diameter smaller than the outer wall 102 of the first cyclonic separator 104 and is tapered. Therefore, the single cyclone 122 is able to separate smaller particles of dirt and dust from the partially-cleaned airflow than the first cyclonic separator 104. Separated dirt and dust exits the single cyclone 122 via the cone opening 128 and is collected in the second collector 130. The cleaned air then flows back up the centre of the single cyclone 122, exits the single cyclone 122 through the air outlet 126 and passes into the duct 134.

From duct 134, the airflow is then divided between the tangential air inlets 140 of the high-efficiency cyclones 138 of the third cyclonic separator 136. Each of the high-efficiency cyclones 138 has a diameter smaller than that of both the first cyclonic separator 104 and the single cyclone 122 of the second cyclonic separator 118. Therefore, the high-efficiency cyclones 138 are able to separate even finer particles of dirt and dust from the airflow than either of the first or second cyclonic separators 104, 118. Separated dirt and dust exits the high-efficiency cyclones 138 via the cone openings and passes into the third collector 144 where it is collected.

Cleaned air then flows back up the high-efficiency cyclones 138, exits the high-efficiency cyclones 138 through the air outlets 142 and enters the outlet 148. The cleaned air then passes from the outlet 148 sequentially through the pre-motor filter, the motor and fan unit, and the post-motor filter before being exhausted from the vacuum cleaner 10 through the air vents (not shown) located on the outer surface of the vacuum cleaner 10.

While the vacuum cleaner 10 is in use and the cyclonic separating apparatus 100 is operating, the speed of the airflow within the cyclonic separating apparatus 100 will be greater than the speed of the atmospheric air surrounding the vacuum cleaner 10. Therefore, the air pressure within the cyclonic separating apparatus 100 will be lower than atmospheric pressure. Consequently, there will be a pressure drop (or differential) across the convex upper surface 168 of the annular seal 166. The pressure in the cavity 175 beneath the annular seal 166 will be positive relative to the pressure in the cyclonic separating apparatus 100. This will cause the annular seal 166 to expand, or inflate, and push upwards against the ends of the cylindrical walls 132, 146. Therefore, the annular seal 166 is able to seal effectively between the three separate collectors 106, 130, 144 even if the collectors 106, 130, 144 are not fully sealed when the vacuum cleaner 10 is switched off; for example, due to a worn seal, a misaligned closure member 150 or the presence of dirt and dust between the annular seal 166 and the cylindrical walls 132, 146.

When a cleaning operation is finished, the collectors 106, 130, 144 of the cyclonic separating apparatus 100 may be full of dirt and dust, and require emptying. To do this, the user switches off the vacuum cleaner 10. When the vacuum cleaner 10 is switched off, the air pressure within the cyclonic separating apparatus 100 will return to atmospheric pressure. Therefore, there will be no pressure drop across the upper surface 168 of the annular seal 166 and so the annular seal 166 will contract, or deflate.

The user releases the cyclonic separating apparatus 100 from the main body 12 by pressing a release button (not shown), removes the cyclonic separating apparatus 100 from the remainder of the vacuum cleaner 10 and places it over a suitable receptacle such as a dustbin. The user then presses a further release button (not shown) in order to release the catch 154.

Figure 8:
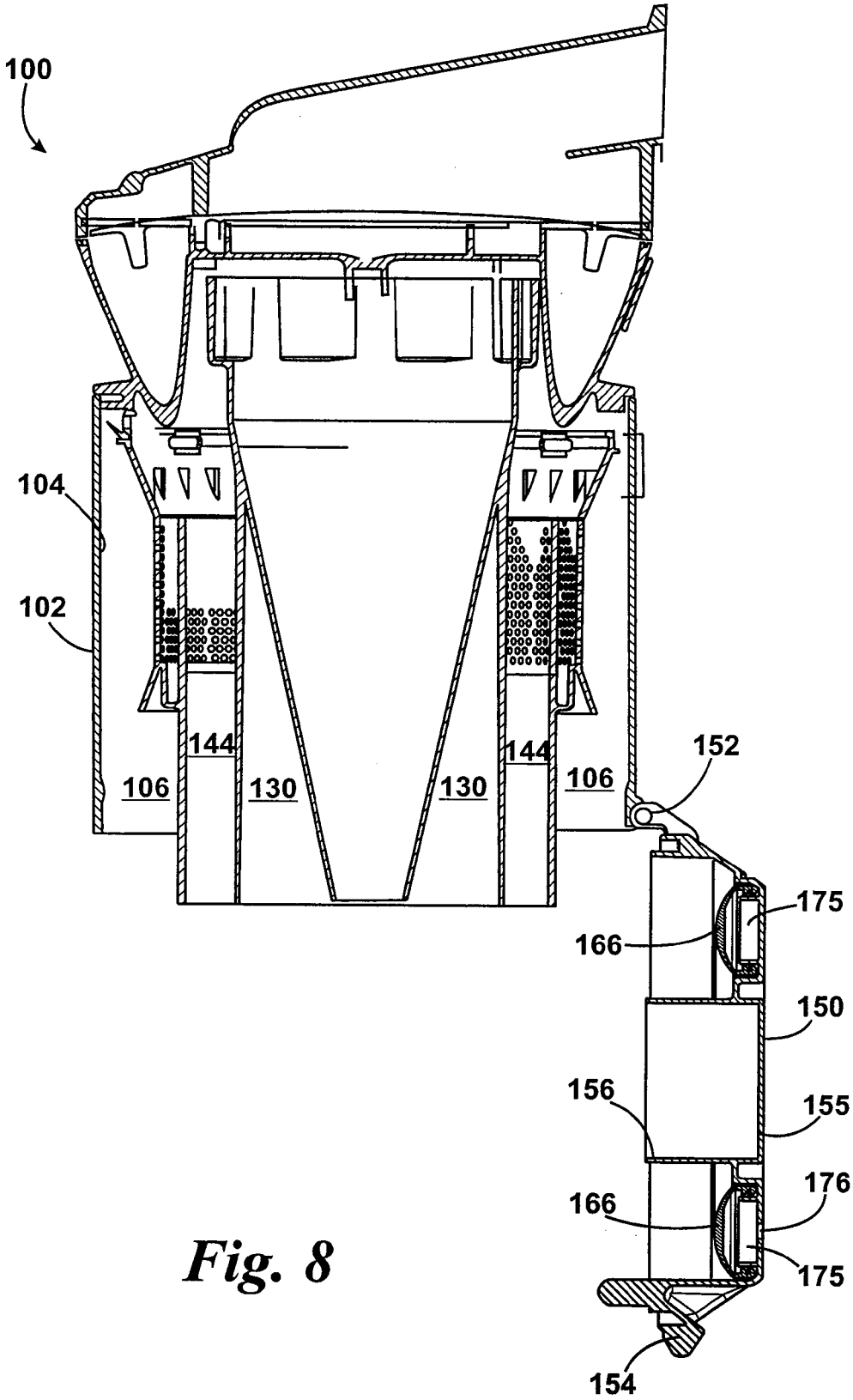
FIG. 8 is a side section of the cyclonic separating apparatus of FIG. 3, with the closure member in an open state.

This action releases the closure member 150, pushing the closure member 150 away from the wall 102 and allowing the closure member 150 to pivot downwardly about the hinge 152 as shown in FIG. 8. Since the annular seal 166 is deflated, the closure member 150 can be opened easily. The dirt and dust collected in the first, second and third collectors 106, 130, 144 can thus be emptied conveniently and efficiently. The first, second and third collectors 106, 130, 144 are emptied simultaneously during this process.

When the cyclonic separating apparatus 100 has been emptied as described above, the user manually moves the closure member 150 back into the closed position shown in FIG. 3. The cyclonic separating apparatus 100 can then be replaced on the main body 12 of the vacuum cleaner 10 (as shown in FIGS. 1 and 2) for further cleaning operations.

Figure 9:
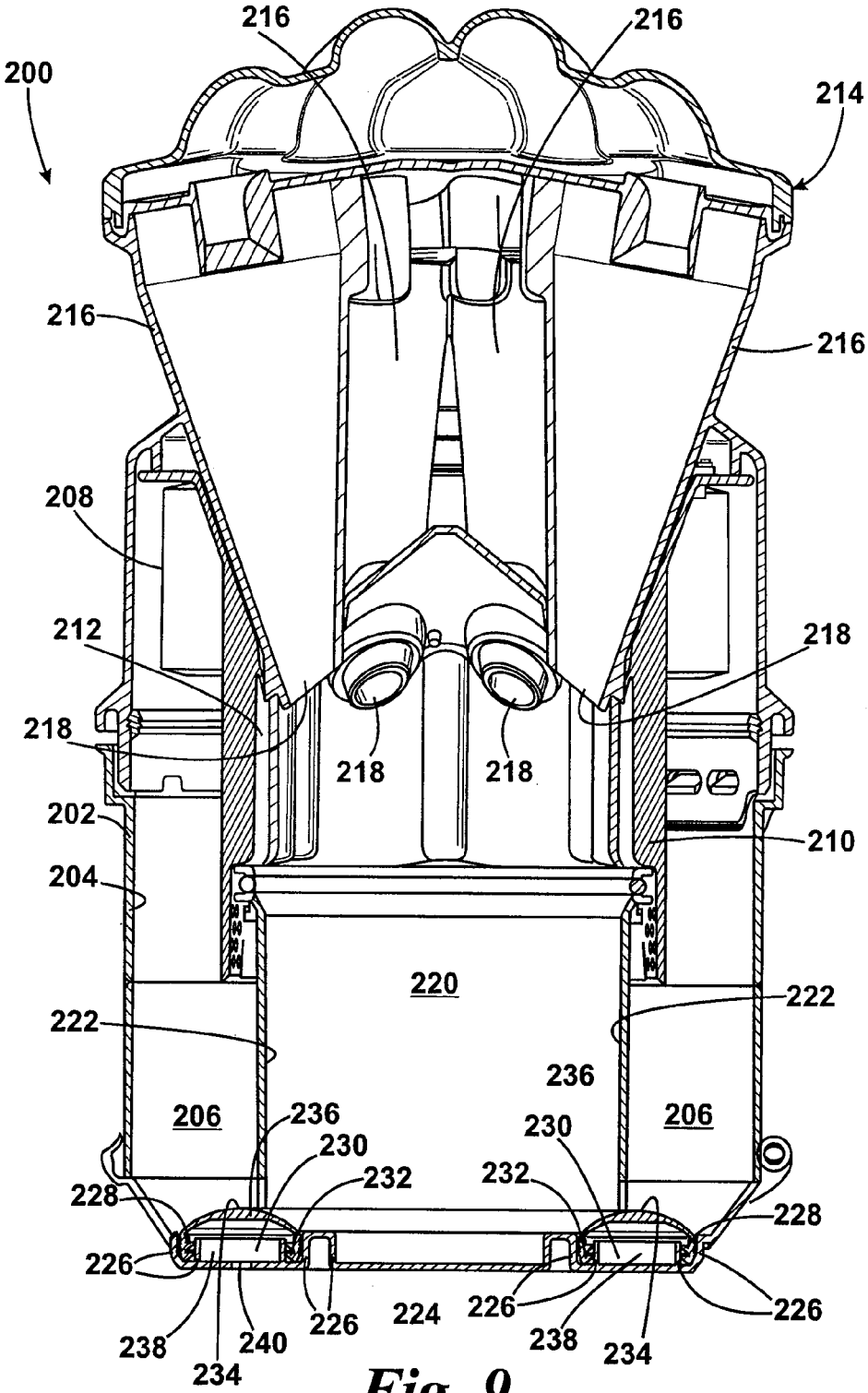
FIG. 9 is a side section through cyclonic separating apparatus according to a second embodiment of the invention.

FIG. 9 shows a side section through cyclonic separating apparatus 200 according to a second embodiment of the invention. The cyclonic separating apparatus 200 is suitable for use in the vacuum cleaner 10 of FIG. 1 in place of the cyclonic separating apparatus 100 of the first embodiment. The cyclonic separating apparatus 200 differs from the cyclonic separating apparatus 100 of the first embodiment in that the cyclonic separating apparatus 200 has only two cyclonic separators.

The cyclonic separating apparatus 200 comprises a substantially cylindrical outer wall 202. The outer wall 202 defines a first cyclonic separator 204 and a first collector 206. An inlet 208 is formed in the outer wall 202. The inlet 208 is arranged tangentially to the first cyclonic separator 204 in the manner of the inlet 108 of the first embodiment.

A shroud 210 is located inwardly of the outer wall 202. The shroud 210 is similar to the shroud 110 of the first embodiment and will not be described any further. A passageway 212 is located downstream of the shroud 210 and provides a communication path between the first cyclonic separator 204 and a second cyclonic separator 214.

The second cyclonic separator 214 comprises a plurality of high-efficiency cyclones 216 arranged in parallel. In this embodiment, six high-efficiency cyclones 216 are provided. Each high-efficiency cyclone 216 has a cone opening 218 in communication with a second collector 220. The second collector 220 is delimited by a cylindrical wall 222 which depends from a lower part of the shroud 210. The first and second collectors 206, 220 are arranged concentrically, with the second collector 220 being arranged inside the first collector 206. The ends of the collectors 206, 220 are separated by the dividing wall 222.

A closure member 224 closes the lower end of the cyclonic separating apparatus 200. The closure member 224 is pivotably mounted on the lower end of the outer wall 202 in a similar manner to the closure member 150 of the first embodiment. The closure member 224 includes four annular walls 226 which delimit three concentric, annular channels 228, 230, 232. The three annular channels 228, 230, 232 comprise a relatively wide channel 230 flanked by two relatively narrow channels 228, 232.

An annular seal 234 is attached to the closure member 224. The annular seal 234 is the same as the annular seal 166 of the first embodiment. However, in this embodiment, the annular seal 234 only seals between the closure member 224 and a single dividing wall 222. As previously, an upper surface 236 of the annular seal 234 covers the relatively wide annular channel 230 of the closure member 224 to define a cavity 238. A plurality of through-holes 240 (although only one is shown in FIG. 9) are formed in the closure member 224 to provide a communication path between the cavity 238 and the external atmosphere. Therefore, the cavity 238 will remain at atmospheric pressure irrespective of the pressure inside the cyclonic separating apparatus 200.

The annular seal 234 is shown in a "relaxed" position in FIG. 9, in which there is no pressure difference across an upper surface 236 of the annular seal 234. However, like the annular seal 166 of the first embodiment, the annular seal 234 will change shape depending upon the magnitude of the pressure difference established across the upper surface 236 thereof when the vacuum cleaner 10 is switched on.

In use, a flow of dirt and dust laden air flows through the inlet 208 and into the cyclonic separating apparatus 200. Larger dirt and dust particles are separated by cyclonic motion in the first cyclonic separator 204, and these particles are collected in the first collector 206. The partially-cleaned airflow exits the first cyclonic separator 204 via through-holes (not shown) in the shroud 210, and is divided between the plurality of high-efficiency cyclones 216 of the second cyclonic separator 214. Dirt and dust is separated in the high-efficiency cyclones 216 and exits via the cone openings 218 to be collected in the second collector 220. The cleaned air then passes back up through the plurality of high-efficiency cyclones 216 and out of the cyclonic separating apparatus 200. The remainder of the operation of the cyclonic separating apparatus 200 is identical to that of the cyclonic separating apparatus 100 as described in the first embodiment.

While the vacuum cleaner 10 is in use and the cyclonic separating apparatus 200 is operating, the pressure in the cavity 238 beneath the annular seal 234 will be positive relative to the pressure in the cyclonic separating apparatus 200. Therefore, the annular seal 234 will expand—the upper surface 236 will be pushed upwards to seal against the end of the dividing wall 222. Therefore, the annular seal 236 is able to seal effectively between the two separate collectors 206, 220 even if the collectors 206, 220 are not fully sealed when the vacuum cleaner 10 is switched off.

The invention is not limited to the detailed description given above. Variations will be apparent to the person skilled in the art. For example, other types of expandable seals may be used; the seal need not be expandable, or inflatable, in response to a pressure difference across a surface of the seal. For example, a thermally-expandable seal which expands when heated may be used. Additionally, the seal need not be annular. Other arrangements, for example, square, rectangular or cylindrical shapes could be used. The seal may also take the form of a sheet.

More than one seal may be used; for example, an individual expandable seal may be located between each dividing wall and the closure member. Additionally, the seal need not be located on the closure member. Other arrangements could be used; for example, the seal could be located on the end of the dividing wall between collectors, or may be located on a separate member between the dividing walls and the closure member.

A part of the cyclonic separating apparatus other than the base may be movable for emptying purposes. Other forms, arrangements and locations of closure members may be used. For example, the side or top of the cyclonic separating apparatus may be movable (or openable). Further, the closure member need not be pivotable. Other opening arrangements for the closure member may be used; for example, sliding, retracting or rotating closure members.

More than three cyclonic separators may be provided. Additionally, more than one collector may be provided with a cyclonic separator. For example, two cyclonic separators may be provided with one of the cyclonic separators having two collectors associated therewith. Further, any number of cyclones may be used in each cyclonic separator.

The cleaning appliance need not be a cylinder vacuum cleaner. The invention is applicable to other types of vacuum cleaner, for example, upright machines, stick-vacuums or hand-held cleaners. Further, the present invention is applicable to other types of cleaning appliances, for example, a wet and dry machine or a carpet shampooer.

The invention claimed is:

1. A cyclonic separating apparatus for a cleaning appliance, comprising:

a plurality of cyclonic separators arranged in series for separating particles from a dirt- and dust-laden airflow, a plurality of collectors for collecting the separated dirt and dust, a closure member movable between a closed position in which the closure member closes an end of each collector and an open position in which separated dirt and dust can be emptied from the collectors, the ends of the collectors being separated by at least one dividing wall, and an expandable seal to seal between the closure member and the at least one dividing wall when the closure member is in the closed position, wherein the seal is expandable in response to a pressure difference across a surface of the seal.

2. The cyclonic separating apparatus of claim 1, wherein the seal is located on the closure member.

3. The cyclonic separating apparatus of claim 2, wherein the seal is located over a channel formed on the closure member.

4. The cyclonic separating apparatus of claim 3, wherein the channel and seal form a cavity which is open to the atmosphere.

5. The cyclonic separating apparatus of claim 1, wherein the seal is annular.

6. The cyclonic separating apparatus of claim 1, wherein first and second cyclonic separators are provided in series and have first and second collectors respectively.

7. The cyclonic separating apparatus of claim 6, wherein a wall of the first collector forms at least a part of an outer wall of the cyclonic separating apparatus and has an air inlet formed therein.

8. The cyclonic separating apparatus of claim 6, wherein the second cyclonic separator comprises a plurality of cyclones in parallel.

9. A cleaning appliance comprising the cyclonic separating apparatus of claim 1.

10. A vacuum cleaner comprising the cleaning appliance of claim 9.

11. A cyclonic separating apparatus, for a cleaning appliance, comprising:

a plurality of cyclonic separators arranged in series for separating particles from a dirt- and dust-laden airflow, a plurality of collectors for collecting the separated dirt and dust, a closure member movable between a closed position in which the closure member closes an end of each collector and an open position in which separated dirt and dust can be emptied from the collectors, the ends of the collectors being separated by at least one dividing wall, and an expandable seal to seal between the closure member and the at least one dividing wall when the closure member is in the closed position, wherein first and second cyclonic separators are provided in series and have first and second collectors respectively, and wherein the second collector is arranged inside the first collector.

12. A cyclonic separating apparatus, for a cleaning appliance, comprising:

a plurality of cyclonic separators arranged in series for separating particles from a dirt- and dust-laden airflow, a plurality of collectors for collecting the separated dirt and dust, a closure member movable between a closed position in which the closure member closes an end of each collector and an open position in which separated dirt and dust can be emptied from the collectors, the ends of the collectors being separated by at least one dividing wall, and an expandable seal to seal between the closure member and the at least one dividing wall when the closure member is in the closed position, wherein first and second cyclonic separators are provided in series and have first and second collectors respectively, and further comprising a third cyclonic separator in series with, and downstream of, the first and second cyclonic separators, the third cyclonic separator having a third collector.

13. The cyclonic separating apparatus of claim 12, wherein the third collector is arranged inside the first collector.

14. The cyclonic separating apparatus of claim 12, wherein the third cyclonic separator comprises a plurality of cyclones in parallel.

15. A cyclonic separating apparatus for a cleaning appliance, comprising:

a plurality of cyclonic separators arranged in series for separating particles from a dirt- and dust-laden airflow, a plurality of collectors for collecting the separated dirt and dust, a closure member movable between a closed position in which the closure member closes an end of each collector and an open position in which separated dirt and dust can be emptied from the collectors, the ends of the collectors being separated by at least one dividing wall, and an expandable seal to seal between the closure member and the at least one dividing wall when the closure member is in the closed position, wherein first and second cyclonic separators are provided in series and have first and second collectors respectively, and wherein the collectors are substantially cylindrical and arranged concentrically with respect to one another.

* * * * *